United States Patent [19]

Ladd, Jr. et al.

[11] Patent Number: 4,671,690

[45] Date of Patent: Jun. 9, 1987

[54] COSMETIC POWDER DISPENSER AND APPLICATOR

[75] Inventors: James E. Ladd, Jr., Rowayton; David R. Jacobs, Norwalk, both of Conn.

[73] Assignee: Laura Lupton Inc., Rowayton, Conn.

[21] Appl. No.: 811,412

[22] Filed: Dec. 20, 1985

Related U.S. Application Data

[63] Continuation-in-part of Ser. No. 752,133, Jul. 5, 1985, Pat. No. 4,626,119.

[51] Int. Cl.[4] ..... A46B 11/00; A46B 11/04

[52] U.S. Cl. ..... 401/123; 132/81; 401/125; 401/277; 401/281

[58] Field of Search ..... 401/281, 123, 125, 277, 401/280; 132/81

[56] References Cited

U.S. PATENT DOCUMENTS

| | | | |
|---|---|---|---|
| 1,588,633 | 6/1926 | Taylor | 401/123 X |
| 1,589,949 | 6/1926 | Dowd | 401/277 |
| 2,164,004 | 6/1939 | Wright | 401/277 |
| 2,480,331 | 8/1949 | Lecker | 401/125 |

FOREIGN PATENT DOCUMENTS

| | | | |
|---|---|---|---|
| 1499599 | 9/1967 | France | 401/277 |

*Primary Examiner*—Steven A. Bratlie

[57] ABSTRACT

A first hollow cylindrical member has a first open end and an opposite closed second end with a plurality of spaced off set axially disposed channels therein. A hollow capsule filled with cosmetic powder is closed at one end and open at the other. The capsule is inserted into the first member with the capsule open end adjacent the second end and communicating with the channels. A second hollow cylindrical member has opposite open third and fourth ends. The inner surface of the second member adjacent the third end is threaded. The second end rotatably engages the third end. A hollow cylindrical element is disposed in the second member and is open at both ends. The element has a thread on its outer surface which engages the inner surface thread of the second member. The element has a like plurality of prongs which are engagable with and disengagable from the channels. Manual rotation of the first member relative to the second member causes the element to rotate in and move back and forth along the axial direction to either cause the prongs to engage and close the channels or to be disengaged from and open the channels. A third member contains a brush and is detachably engaged via an open end to the fourth end.

7 Claims, 5 Drawing Figures

COSMETIC POWDER DISPENSER AND APPLICATOR

CROSS REFERENCE TO COPENDING APPLICATION

This application is a continuation-in-part of copending application entitled "Cosmetic Powder Dispenser and Applicator", filed July 5, 1985, Ser. No. 752133 now U.S. Pat. No. 4,626,119.

BACKGROUND OF THE INVENTION

The copending application Ser. No. 752,133 discloses a cosmetic powder dispenser and applicator in which first and second members have a first position of relative rotation at which openings in the two members are aligned and powder can flow through the aligned openings onto a brush for application by the user. These members have a second position of relative rotation at which this powder flow is blocked. The present invention is directed to this type of powder dispenser and applicator wherein a combination of rotational and longitudinal motions are employed to produce control of powder flow.

SUMMARY OF THE INVENTION

In accordance with the principles of the invention, a cosmetic powder dispenser and applicator employs a first cylindrical hollow member having first and second opposite ends. The first end is open. The second end is closed except for a plurality of off set axially extending channels therein.

An elongated capsule adapted to be filled with cosmetic powder is closed at one end and is open at the other. The capsule is removably slidable into and out of the first member. The capsule, when inserted in the first member, has its open end adjacent the second end of the first member and communicating with the channels. The closed end of the capsule closes the first end of the first member.

A second cylindrical hollow member has third and fourth oppositely disposed open ends. The inner surface of the second member adjacent the third end is threaded. The second end of the first member rotatably engages the third end of the second member.

A cylindrical hollow element open at both ends is disposed in the second member. The element has a thread on its outer surface which engages the inner surface thread of the second member. The element has means which are engagable with and disengagable from the corresponding channels in the second face. Manual rotation of the first member with respect to said second member causes the element to rotate in and to move back and forth along the axial direction of the second member. The first and second members have a first relative position of rotation at which the means engage and close the channels, thus blocking communication between the interior of the capsule and the channels, and have a second position of relative rotation at which the means are disengaged from and no longer close the channels, thus establishing such communication.

A third cylindrical hollow member has an open fifth end. A brush has a plurality of essentially parallel bristles with powder applying tips. The brush is slidably disposed in the third member. The brush has a first extended position at which the bristles extend almost entirely out of the third member and a second withdrawn position at which the brush is disposed within the third member. The brush carrying end of the third member is disposed removably in the fourth end of the second member.

In use, the three members are disposed end to end, and the dispenser and applicator is disposed vertically with the first member disposed above the third member, the brush being in withdrawn position in the third member.

The first and second members are then placed into the second position of relative rotation whereby powder flows out of the capsule through the off set channels and the second member onto the bristles. The members are then placed into the first position of relative rotation to block powder flow. The third member can then be detached and the brush moved into the forward position to expose the bristles. By using the third member as a handle, the user can apply the powder as needed.

DETAILED DESCRIPTION OF PREFERRED EMBODIMENTS

Figures 1, 2, 3A, 3B, 4:
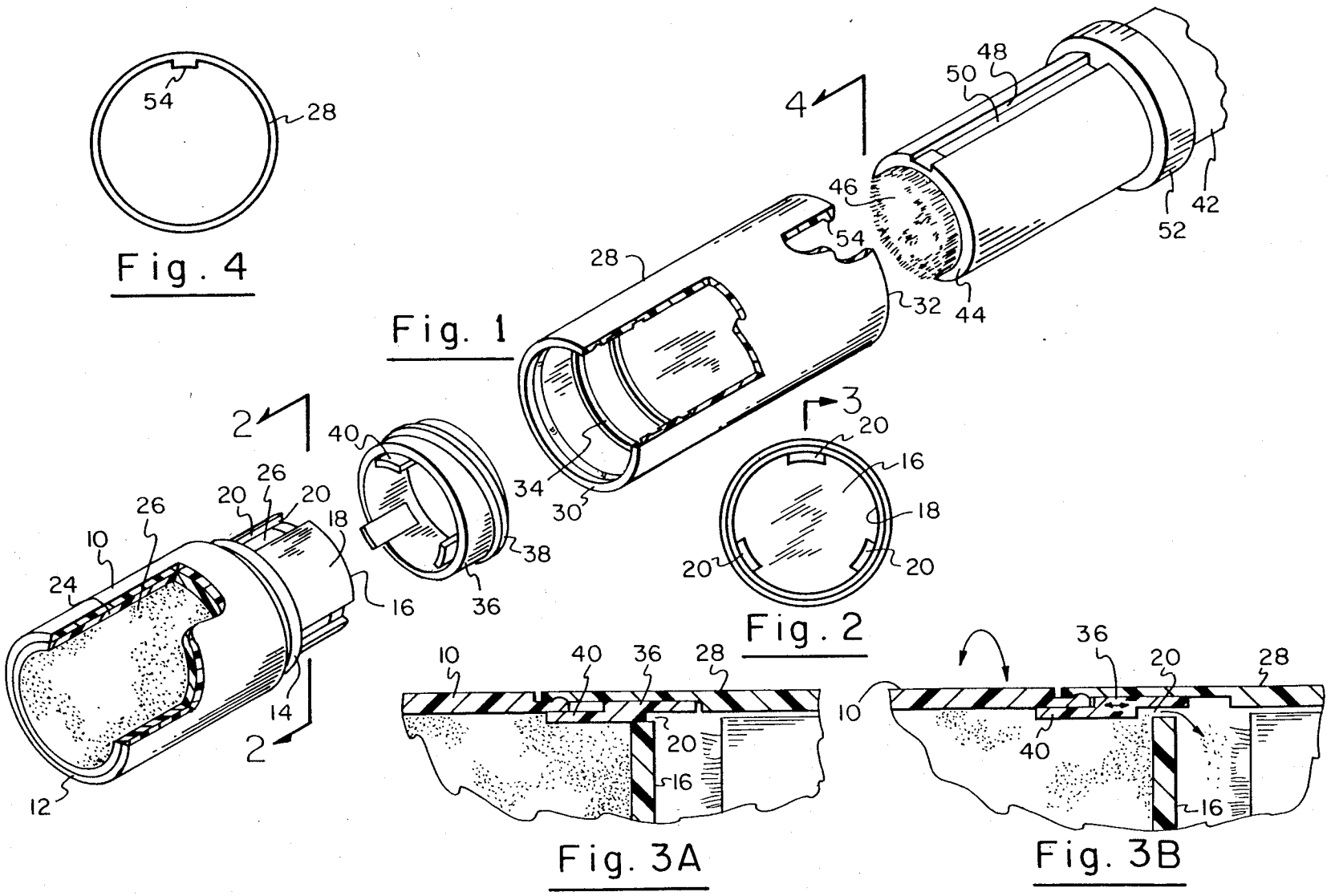
FIG. 1 is an exploded view illustrating one embodiment of the invention.
FIG. 2 is a view taken along line 2—2 in FIG 1.
FIGS. 3A and 3B are detail views taken along line 3—3 in FIG. 2 showing the positions of channels and cooperating means when the first and second members are in the first and second positions of relative rotation respectively.
FIG. 4 is a cross sectional view taken along line 4—4 in FIG. 1.

Referring to FIGS. 1–4, a first elongated hollow cylindrical plastic member 10 has one open end 12 and an opposite closed end 16. Member 10 has a shoulder 14 disposed intermediate the ends and a portion 18 of smaller diameter extending from the shoulder to end 16. End 16 has three equidistantly spaced channels 20 off set from the center of this end. In the the embodiment shown, these channels are disposed peripherally and extend axially along portion 18 through the shoulder.

A hollow elongated plastic capsule 24 can be filled with cosmetic powder 26 and slidably and removably inserted into member 10 via its open end 12. The capsule has a closed transparent end which meets the open end of member 10 in flush engagement. The opposite end of the capsule is open and abuts end 16 to communicate with the channels. This opposite end can be transparent to enable the user to determine visually how much powder remains to be used.

A second hollow elongated cylindrical member 28 has two opposite open ends 30 and 32. The inner surface of member 28 adjacent end 30 carries a helical thread 34. End 30 and shoulder 14 are so constructed that shoulder 14 snap fits rotatably into end 30. Consequently, member 10 is rotatably engaged to member 28.

A hollow cylindrical element 36 open at both ends is disposed in member 28 and has an outer thread 38 which engages thread 34. One end of element 36 has three elongated prongs 40. Each prong 40 can be engaged with or disengaged from a corresponding channel 20. When member 28 is held non-rotatably while member 10 is rotated, element 36 is rotated in and moves back and forth along the axial direction of the member 28. Members 10 and 28 have a first position of relative rotation, as shown in FIG. 3A, in which prongs 40 engage and close the channels, whereby powder cannot flow out of the capsule into the channels. Members 10 and 28 have a second position of relative rotation, as shown in FIG. 3B, in which prongs 40 are disengaged from and open the channels by passing completely therethrough and into the capsule whereby powder can flow out of the capsule into the channels.

A third hollow elongated plastic member 42 has one open end 44 and an opposite closed end. A brush with substantially parallel bristles 46 is slidably disposed in the open end 44. That portion of member 42 adjacent end 44 has two oppositely disposed longitudinally extending slots 48, only one of which is visible in the drawing.

The outer surface of the brush has two oppositely disposed elongated runners 50, each runner riding in a corresponding slot 48. The runners are secured at one end to ring 52 which is also the base for the bristles.

The brush can be slid forward so that the bristles are almost entirely exposed, or can be withdrawn so that the brush is disposed within the third member. The positions of the slots and runners are such that the brush is always secured to member 44 which can act as a brush handle.

End 32 can have an inwardly extending dimple 54 which engages one of the slots 48 so that member 42 cannot be rotated relative to member 28.

This arrangement enables a user to hold either one of members 28 or 42 stationary when rotating member 10.

The three members all have a common longitudinal axis. When the dispenser and applicator is disposed vertically, powder can be transferred from the capsule onto the bristles for use as previously described.

What is claimed is:

1. A cosmetic powder dispenser and applicator comprising:

a first hollow cylindrical member having a first open end and an opposite closed end with a plurality of off set spaced apart channels therein;

a hollow capsule, adapted to be filled with cosmetic powder, closed at one end and open at the other and removably slidable into said first member, the capsule, when inserted in the first member, having its open end adjacent the second end of the first member and communicating with said channels and its closed end closing the first end of the first member;

a second hollow cylindrical member having third and fourth oppositely disposed open ends, the inner surface of said second member adjacent said third end being threaded, the second end of the first member rotatably engaging the third end of the second member;

a hollow cylindrical element disposed in the second member and open at both ends, said element having a thread on its outer surface which engages the inner surface thread of the second member, said element having a like plurality of means which are engagable with and disengagable from the corresponding openings, whereby manual rotation of the first member with respect to said second member causes the element to rotate in and to move back and forth along the axial direction of the second member, the first and second members having a first relative position of rotation position at which the means engage and close said channels and having a second relative rotation position at which the means are disengaged from and open said channels;

a third elongated hollow member having an open fifth end; and a brush having a plurality of essentially parallel bristles with powder applying tips, the brush being slidably disposed in the third member, the fifth end of the third member removably engaging the fourth end of the second member.

2. The dispenser and applicator of claim 1 wherein said means are prongs.

3. The dispenser and applicator of claim 2 wherein said prongs engage and close the channels where said first and second members are in the first position and pass out of the channels into the capsule when these members are in the second position.

4. The dispenser and applicator of claim 3 wherein said capsule contains powder which can flow out of the capsule through the channels and second member onto the brush when the first and second members are in the second position and wherein said flow is blocked when these members are in the first position.

5. The dispenser and applicator of claim 4 wherein said third member non-rotatably and removably engages said second member.

6. The dispenser and applicator of claim 5 wherein said channels are disposed along the periphery of the closed end.

7. The dispenser and applicator of claim 6 wherein said channels are equidistantly spaced.

* * * * *